US008553903B2

(12) United States Patent
Greywall

(10) Patent No.: US 8,553,903 B2
(45) **Date of Patent: *Oct. 8, 2013**

(54) SOUND-DIRECTION DETECTOR HAVING A MINIATURE SENSOR

(75) Inventor: Dennis S. Greywall, White House Station, NJ (US)

(73) Assignee: Alcatel Lucent, Paris (FR)

( * ) Notice: Subject to any disclaimer, the term of this patent is extended or adjusted under 35 U.S.C. 154(b) by 1675 days.

This patent is subject to a terminal disclaimer.

(21) Appl. No.: 11/769,142

(22) Filed: Jun. 27, 2007

(65) Prior Publication Data

US 2009/0003621 A1 Jan. 1, 2009

(51) Int. Cl.
*H04R 3/00* (2006.01)

(52) U.S. Cl.
USPC ..... 381/92; 381/91; 381/122

(58) Field of Classification Search
USPC ..... 381/92, 91, 122
See application file for complete search history.

(56) References Cited

U.S. PATENT DOCUMENTS 5,703,957 A * 12/1997 McAteer ..... 381/92
2007/0086603 A1* 4/2007 Lyon et al. ..... 381/96
2009/0101997 A1* 4/2009 Lammel et al. ..... 257/415

* cited by examiner

*Primary Examiner* — Vivian Chin
*Assistant Examiner* — Paul Kim
(74) *Attorney, Agent, or Firm* — Mendelsohn, Drucker & Associates; Yuri A. Gruzdkov; Steve Mendelsohn

(57) ABSTRACT

A representative embodiment of the invention provides a sound-direction detector having a miniature sensor coupled to a signal-processing block. The sensor has (i) a microphone responsive to a sound wave and (ii) a differential pressure sensor (DPS) responsive to a pressure difference induced by the sound wave between two inlet ports located in proximity to the microphone. The signal-processing block applies phase-sensitive detection to the output signal generated by the DPS, while using the output signal generated by the microphone as a reference for the phase-sensitive detection, to measure the pressure difference. The signal-processing block then determines direction to the sound-wave source based on the amplitude of the sound wave at the microphone and the measured pressure difference.

20 Claims, 7 Drawing Sheets

220

SOUND-DIRECTION DETECTOR HAVING A MINIATURE SENSOR

BACKGROUND OF THE INVENTION

1. Field of the Invention

The present invention relates to acoustic equipment.

2. Description of the Related Art

Sound-direction detectors have a wide range of applications, such as (i) in speech recognition systems, to steer microphones to help separate speech from other sound sources; (ii) in robotics, to direct cameras to a sound source; (iii) in safety devices, e.g., to alert a deaf person; and (iv) in military devices, to help detect the source of enemy fire. A typical prior-art sound-direction detector employs a sound-direction sensor having multiple, spatially-distributed microphones that are separated by distances comparable to or larger than the wavelength of sound. Signals received from a sound source by different microphones have small differences due to different sound propagation paths. These differences are measured by the detector and the measurement results are processed to obtain the sound-direction information.

Vowel and consonant sounds in human speech have average wavelengths (frequencies) of about 110 mm (3 kHz) and 66 mm (5 kHz), respectively. As a result, a prior-art speech-direction sensor has a linear size of at least about 10 cm. Sound-direction sensors for other types of sound have similar dimensions. Attempts to miniaturize these prior-art sensors, e.g., to a linear size of several millimeters, while maintaining the angular accuracy of several degrees, have been largely unsuccessful because signal differences for microphones separated by several millimeters tend to be very small. Consequently, the sound-direction information extracted from such small differences disadvantageously lacks the requisite accuracy.

SUMMARY OF THE INVENTION

A representative embodiment of the invention provides a sound-direction detector having a miniature sensor coupled to a signal-processing block. The sensor has (i) a microphone responsive to a sound wave and (ii) a differential pressure sensor (DPS) responsive to a pressure difference induced by the sound wave between two inlet ports located in proximity to the microphone. The signal-processing block applies phase-sensitive detection to the output signal generated by the DPS, while using the output signal generated by the microphone as a reference for the phase-sensitive detection, to measure the pressure difference. The signal-processing block then determines direction to the sound-wave source based on the amplitude of the sound wave at the microphone and the measured pressure difference. Advantageously over the above-described prior-art sound-direction detectors, a sound-direction detector of the invention can employ a sensor whose linear size is smaller than about 7 mm, while being able to achieve an angular accuracy of about several degrees.

According to one embodiment, a device of the invention comprises: (i) a microphone adapted to generate a microphone signal in response to a sound wave from a sound-wave source; (ii) a differential pressure sensor (DPS) adapted to generate a DPS signal in response to a pressure difference induced therein by said sound wave; and (iii) circuitry adapted to determine direction to the sound-wave source based on the microphone signal and the DPS signal.

According to another embodiment, a method of the invention comprises the steps of: (A) generating a microphone signal in response to a sound wave from a sound-wave source; (B) generating a differential pressure sensor (DPS) signal in response to a pressure difference induced by said sound wave; and (C) determining direction to the sound-wave source based on the microphone signal and the DPS signal.

According to yet another embodiment, an integrated device of the invention comprises: (i) a microphone formed in a multilayered wafer and adapted to generate a microphone signal in response to a sound wave; and (ii) a differential pressure sensor (DPS) formed in the multilayered wafer and adapted to generate a DPS signal in response to a pressure difference induced therein by said sound wave.

BRIEF DESCRIPTION OF THE DRAWINGS

Other aspects, features, and benefits of the present invention will become more fully apparent from the following detailed description, the appended claims, and the accompanying drawings in which:

DETAILED DESCRIPTION

Figure 1:
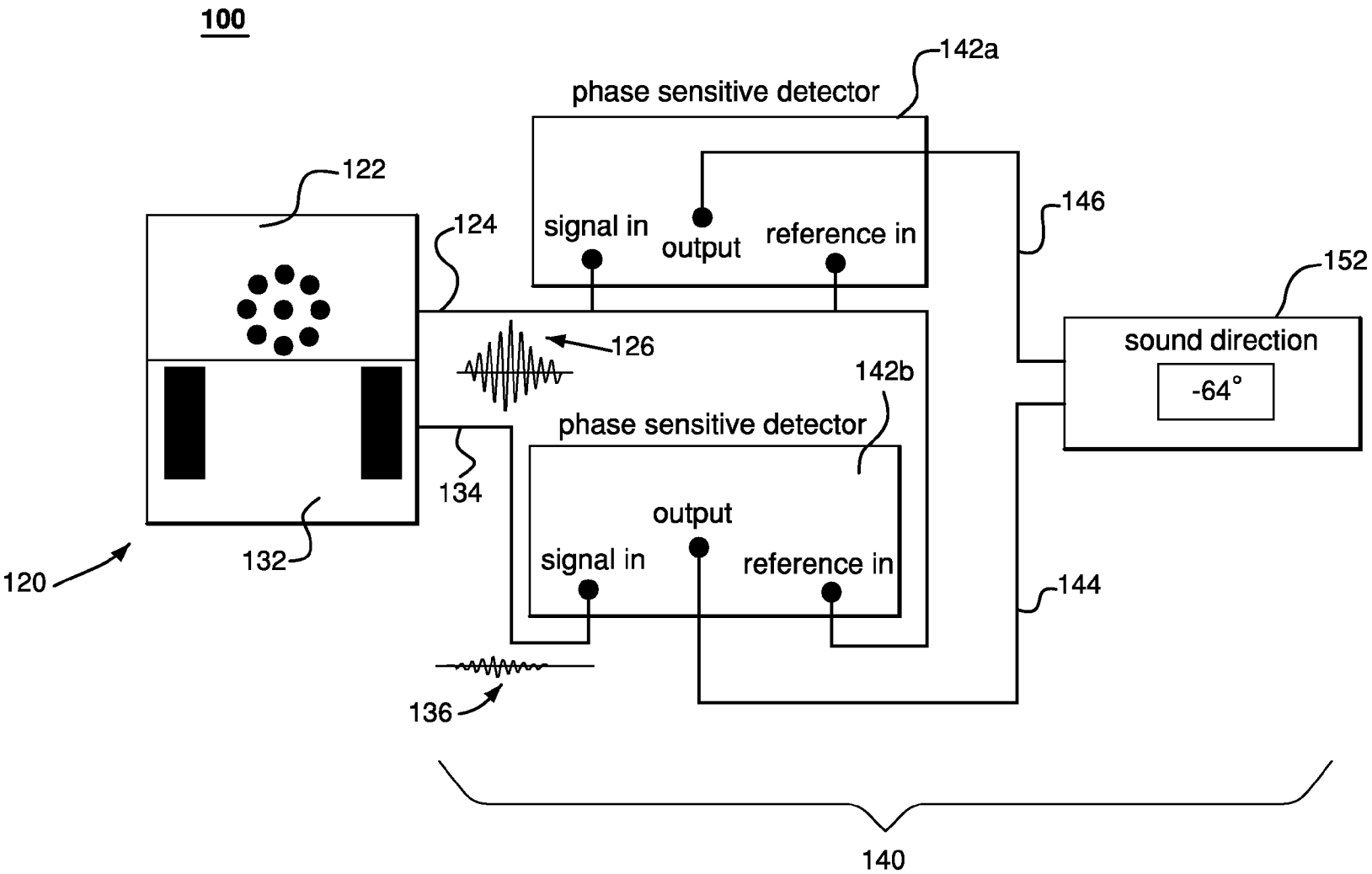
FIG. 1 shows a block diagram of a sound-direction detector according to one embodiment of the invention.

FIG. 1 shows a block diagram of a sound-direction detector 100 according to one embodiment of the invention. Detector 100 has a sound-direction sensor 120 coupled to a signal-processing block 140. Sensor 120 has a microphone 122 and a differential pressure sensor (DPS) 132. Block 140 has phase-sensitive detectors (PSDs) 142*a-b* coupled to a signal processor 152. A signal 124 generated by microphone 122 is applied to both PSDs 142*a-b*. A signal 134 generated by DPS 132 is applied to PSD 142*b*. Waveforms 126 and 136 show representative time profiles of signals 124 and 134, respectively, corresponding to a burst of sound. Typically, signal 124 is relatively strong, and signal 134 is relatively weak.

As shown below, a pressure difference component of signal 134 has a 90-degree phase shift with respect to signal 124. To measure the amplitude of that component and filter out any noise components, PSD 142*b* uses a 90-degree phase-shifted version of signal 124 as a reference. PSD 142*b* then provides the amplitude-measurement result via an output signal 144 to processor 152. PSD 142*a* measures the amplitude of signal 124 using that signal itself as a reference and provides the amplitude-measurement result via an output signal 146 to processor 152. Processor 152 determines the direction to the sound source based on signals 144 and 146, and optionally displays the determination result on a screen for the detector's user. Advantageously over the above-described prior-art sound-direction detectors, detector 100 can employ sensor 120 whose linear size is about 2 mm or smaller, while being able to achieve an angular accuracy of about several degrees.

Figure 2:
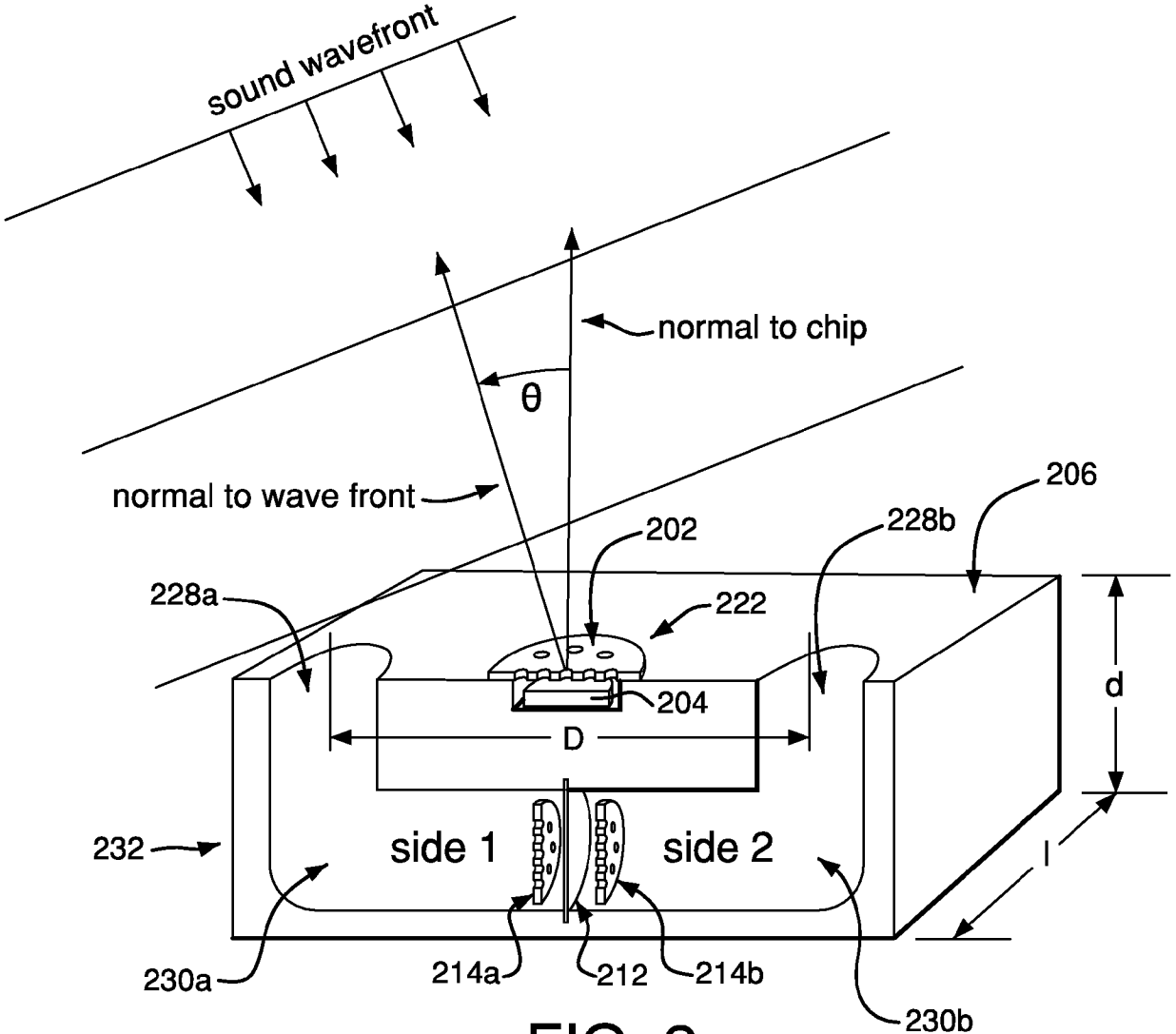
FIG. 2 shows a cutout perspective view of a sound-direction sensor that can be used in the detector shown in FIG. 1 according to one embodiment of the invention.

FIG. 2 shows a cutout perspective view of a sound-direction sensor 220 that can be used as sound-direction sensor 120 according to one embodiment of the invention. Sensor 220 has a perforated diaphragm 202 that together with an underlying electrode 204 form a conventional (capacitance) microphone 222. When sensor 220 is employed in detector 100, microphone 222 generates signal 124.

Sensor 220 further has a diaphragm 212 that is not perforated. Diaphragm 212 divides a chamber 230 into two portions 230*a-b*, with each portion having a corresponding inlet port 228. On each side of diaphragm 212, sensor 220 has a respective one of perforated rigid electrodes 214*a-b*. Either one of electrodes 214*a-b* (or both) can be used to sense a displacement of diaphragm 212 with respect to a reference position, e.g., by measuring changes in the capacitance of the capacitor formed by that diaphragm and the respective electrode 214. Chamber portions 230*a-b*, diaphragm 212, and electrodes 214*a-b* form a DPS 232. When sensor 220 is employed in detector 100, DPS 232 generates signal 134.

Pressure waves that reach the two sides of diaphragm 212 when a sound wave strikes sensor 220 can be expressed as follows:

$$P_a = P_o e^{i\omega t} \tag{1a}$$

$$P_b = P_o e^{i(\omega t - \phi)} \tag{1b}$$

where $P_a$ and $P_b$ are the pressure waves reaching diaphragm 212 through chamber portions 230*a* and 230*b*, respectively; $P_0$ is the amplitude of the sound wave; ω is the sound frequency; t is time; and ϕ is a phase given by Eq. (2):

$$\varphi \approx \frac{D\sin\theta}{\lambda_{sound}} \cdot 2\pi \tag{2}$$

where D is the distance between inlet ports 228*a-b*; θ is the angle between the normal to surface 206 and the normal to the wavefront (also see FIG. 2); and $\lambda_{sound}$ is the sound wavelength. Note that Eq. (2) assumes that $D \ll \lambda_{sound}$ (e.g., $D \leq 0.1\lambda_{sound}$). For example, for $\lambda_{sound}$ of about 70 mm, Eq. (2) is sufficiently accurate for D values that are smaller than about 7 mm. It is clear from Eq. (2) that, for small D, ϕ is also small for any sound-wave incidence angle θ. Based on the latter observation, the pressure difference (ΔP) acting upon membrane 212 can be expressed as follows:

$$\Delta P = P_b - P_a = P_o e^{i\omega t}(e^{-i\phi} - 1) \approx P_o e^{i\omega t}. (-i \sin\phi) \approx -\phi P_o e^{i(\omega t + \pi/2)} \tag{3}$$

Analysis of Eq. (3) provides three important observations: (1) the pressure difference induced by a sound wave between chamber portions 230*a-b* has a 90-degree phase shift with respect to the pressure itself; (2) the amplitude of the pressure difference is proportional to phase ϕ; and (3) the phase and amplitude of the pressure difference are independent of frequency. Based on these observations, it is relatively straightforward to program processor 152 to extract sound-direction information from signals 144 and 146 (see FIG. 1). For example, signal 146 can be used to determine the sound-wave amplitude $P_0$. Signal 144 can then be used to determine ϕ, e.g., by scaling that signal by $1/P_0$ (see Eq. (3)). Finally, the value of θ between −90 and +90 degrees can be determined using Eq. (2).

Note that, due to the presence of a sine function in Eq. (2), the direction to the sound source can be determined with an ambiguity of 180 degrees. That is, sensor 220 generates substantially the same response for sound waves arriving from the front side (e.g., surface 206) or from the opposite side of the sensor. One way of removing this ambiguity is to employ two or more sensors 220 in a single sound-direction detector, e.g., with two of the sensors oriented at 90 degrees with respect to each other. Alternatively, the ambiguity can be left to the user to resolve, e.g., based on the user's own sensory perception (which is not limited to sound only, but may include other senses, such as vision) and/or knowledge that the sound-source is expected to be found within a certain angle cone.

In one embodiment, sensor 220 can have the following dimensions: a width (D) of about 2 mm, a thickness or height (d) of about 0.5 mm, and a depth (l) of about 1 mm. These sizes advantageously represent a significant size reduction with respect to the linear sizes of prior-art sensors. As indicated above, this size reduction is enabled by the utilization of phase-sensitive detection for the signals generated by DPS 232, which detection is significantly more sensitive than the differential signal processing relied upon in prior-art sound-direction detectors.

Figure 3A:
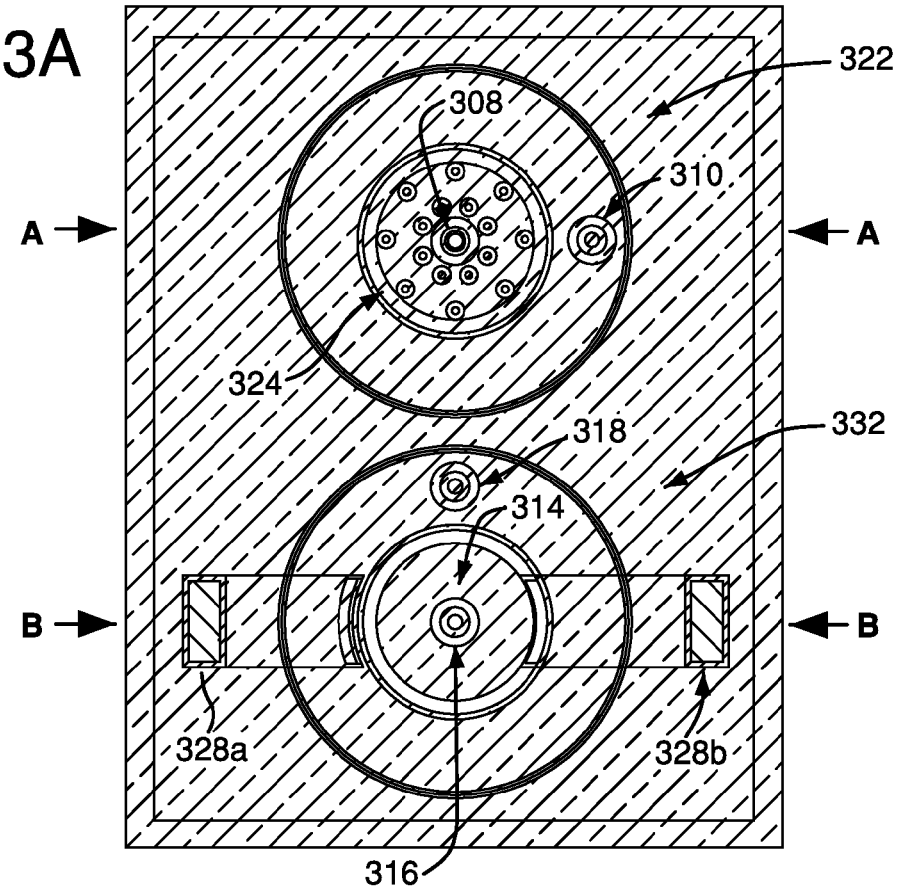
FIGS. 3A-C show top and cross-sectional side views of a sound-direction sensor that can be used in the detector shown in FIG. 1 according to another embodiment of the invention.
Figure 3B:
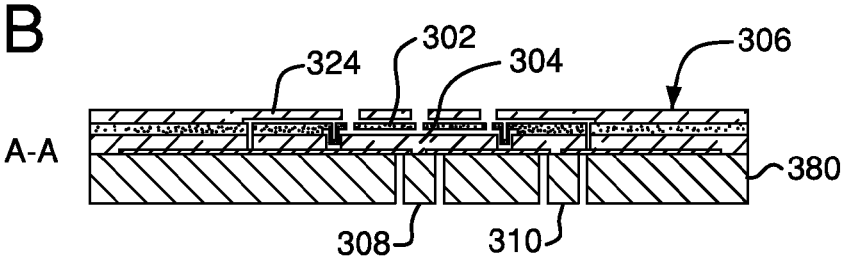
Figure 3C:
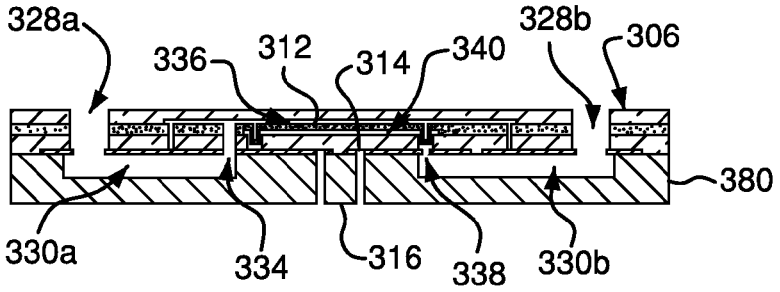

FIGS. 3A-C show a sound-direction sensor 320 that can be used as sound-direction sensor 120 according to another embodiment of the invention. More specifically, FIG. 3A shows a top view of sensor 320, and FIGS. 3B-C show cross-sectional side views of the sensor along the planes labeled AA and BB, respectively, in FIG. 3A.

Sensor 320 is generally analogous to sensor 220, with the analogous elements of the two sensors designated with labels having the same last two digits. However, one difference between sensors 220 and 320 is that, in the latter sensor, membrane 312 of DPS 332 is parallel to front surface 306 whereas, in the former sensor, membrane 212 of DPS 232 is oriented orthogonally to front surface 206. This orientation of membrane 312 simplifies the fabrication process for sensor 320, during which multiple successive layers of material are deposited over a substrate 380 and one of those layers is used to form the membrane.

Referring to FIG. 3B, microphone 322 of sensor 320 is a conventional (capacitance) microphone having electrode 304 and perforated membrane 302. Electrode 304 can be connected to external circuitry (e.g., block 140 of FIG. 1) via an electrical lead 308 formed using the material of substrate 380. Membrane 302 can similarly be connected to external circuitry via an electrical lead 310 that is analogous to electrical lead 308. A wire pair (not explicitly shown in FIG. 3) connected to electrical leads 308 and 310 can then be used to fetch, e.g., signal 124 (see also FIG. 1) from microphone 322. A perforated cover 324 located above membrane 302 serves to protect that membrane from accidental damage.

Referring to FIG. 3C, chamber portion 330*a* of DPS 332 has a slot 334 that connects a volume 336 located above membrane 312 to the main volume of that chamber portion, which, in turn, is connected to the exterior volume via inlet port 328*a*. Similarly, chamber portion 330*b* has a slot 338 that connects a volume 340 located below membrane 312 to the main volume of that chamber portion, which, in turn, is connected to the exterior volume via inlet port 328*b*. Electrode 314 can be connected to external circuitry (e.g., block 140 of FIG. 1) via an electrical lead 316 that is generally similar to each of electrical leads 308 and 310. Membrane 312 can similarly be connected to external circuitry via a similar electrical lead 318 (not visible in FIG. 3C, but having its contours outlined in FIG. 3A). A wire pair (not explicitly shown in FIG. 3) connected to electrical leads 316 and 318 can then be used to fetch, e.g., signal 134 (see also FIG. 1) from DPS 332.

In one embodiment, sensor 320 is a substantially planar MEMS device whose thickness or height is smaller than the sensor's lateral dimensions, such as length and width. Front surface 306 of sensor 320 is substantially parallel to the plane of the device defined by substrate 380. Microphone 322 and DPS 332 are formed within the wafer having substrate 380 and located therein in close proximity to each other. Membrane 302 of microphone 322 and membrane 312 of DPS 332 are formed using the same layer of the wafer and, as such, are parallel to each other. Membranes 302 and 312 are also parallel to front surface 306 and substrate 380.

FIGS. 4A-G illustrate representative fabrication steps for sensor 320 (FIG. 3) according to one embodiment of the invention. More specifically, each of FIGS. 4A-G shows three views labeled (i), (ii), and (iii), respectively. Each view (i) is a top view of a multilayered wafer, using which sensor 320 is being fabricated, at the corresponding fabrication step. Each of views (ii) is a cross-sectional side view of the multilayered wafer along the plane labeled AA in view (i). Each of views (iii) is a cross-sectional side view of the multilayered wafer along the plane labeled BB in view (i). The final structure of sensor 320 manufactured using the fabrication process of FIGS. 4A-G is shown in FIGS. 3A-C, to which the description of FIGS. 4A-G provided below also refers.

Figure 4B:
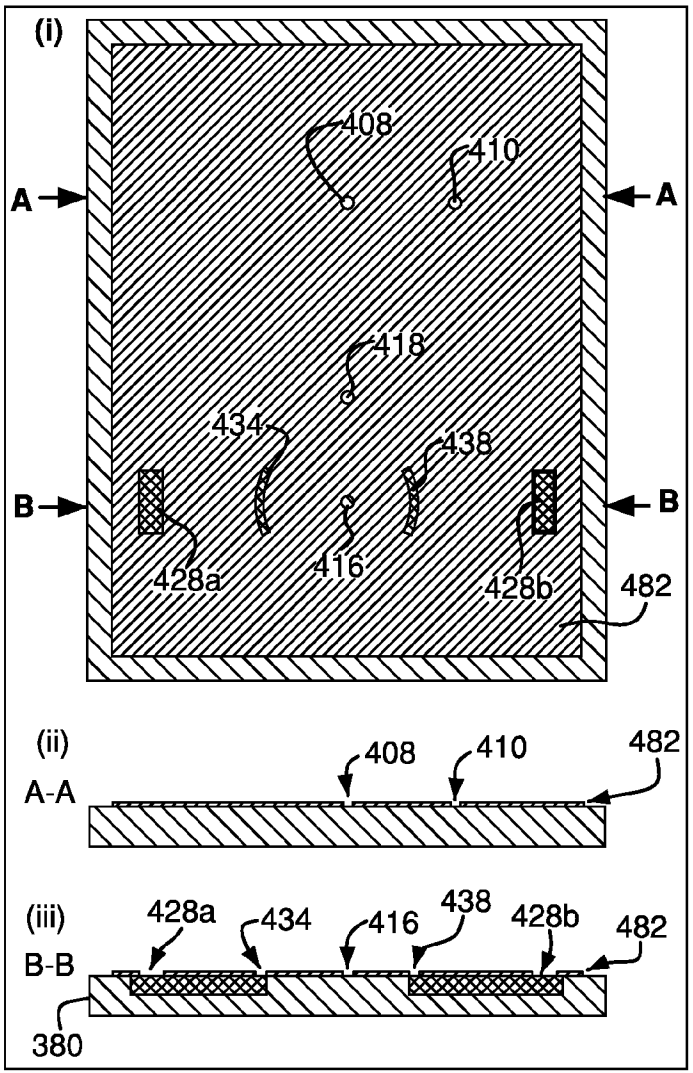
FIGS. 4A-G illustrate representative fabrication steps for the sensor shown in FIG. 3 according to one embodiment of the invention.
Figure 4A:
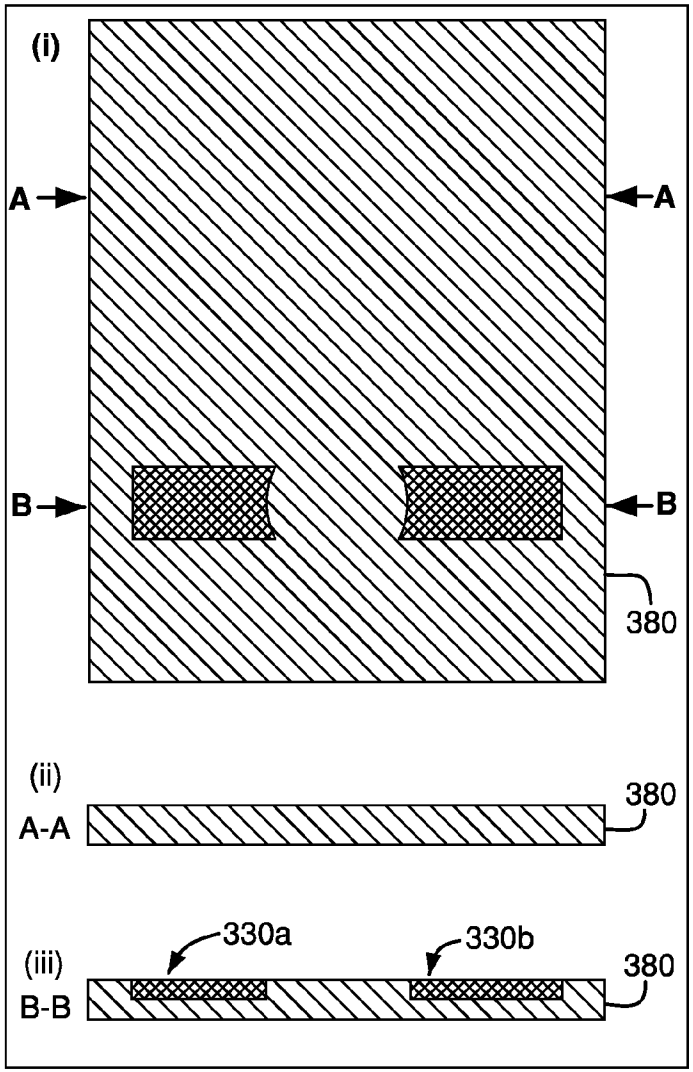

Referring to FIGS. 4A(i)-(iii), fabrication of sensor 320 begins with silicon substrate 380. First, substrate 380 is patterned and etched to form cavities for chamber portions 330*a-b*. The cavities are then filled with fast-etching silicon oxide, preferably in form of phosphosilicate glass (PSG).

Referring to FIGS. 4B(i)-(iii), first, a silicon-nitride layer 482 is deposited over the structure of FIG. 4A. Layer 482 is then patterned and etched as indicated to form vias 408, 410, 416, and 418 and openings 428*a-b*, 434, and 438. Vias 408, 410, 416, and 418 will be filled with conducting material to electrically connect each of leads 308, 310, 316, and 318 (see FIG. 3) to the respective membrane or electrode. Openings 428*a-b* will be used to connect inlet ports 328*a-b* with chamber portions 330*a-b*, respectively. Openings 434 and 438 will be used to connect volumes 336 and 340, respectively, with the corresponding chamber portions.

Figure 4D:
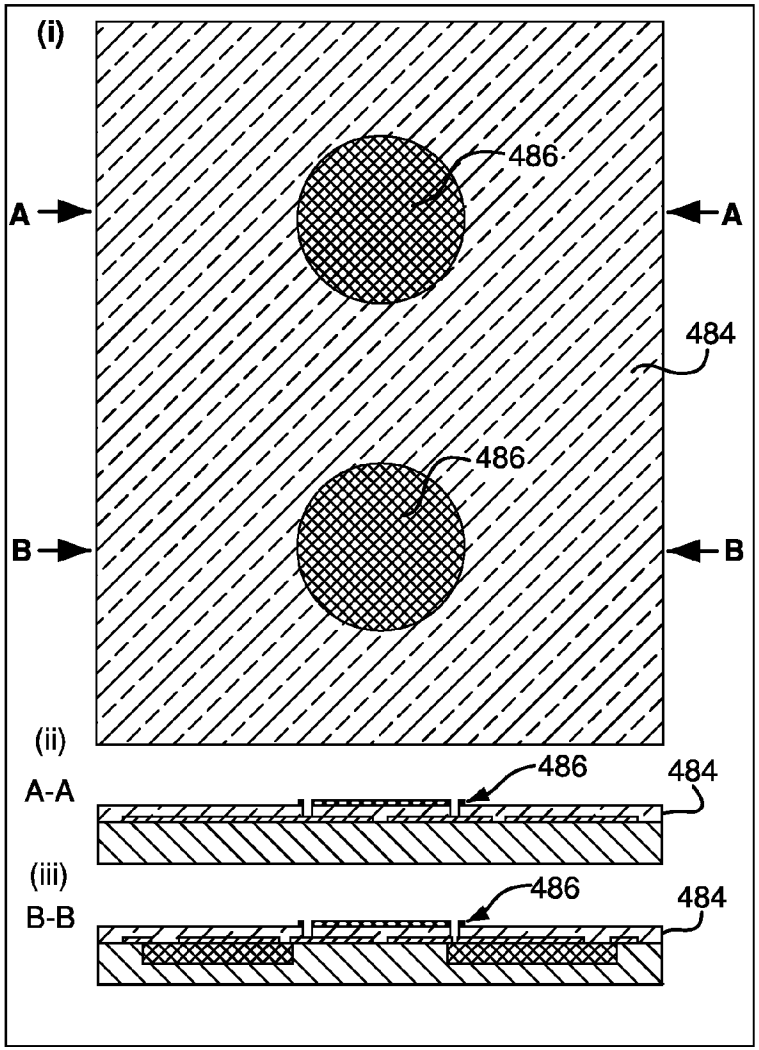
Figure 4C:
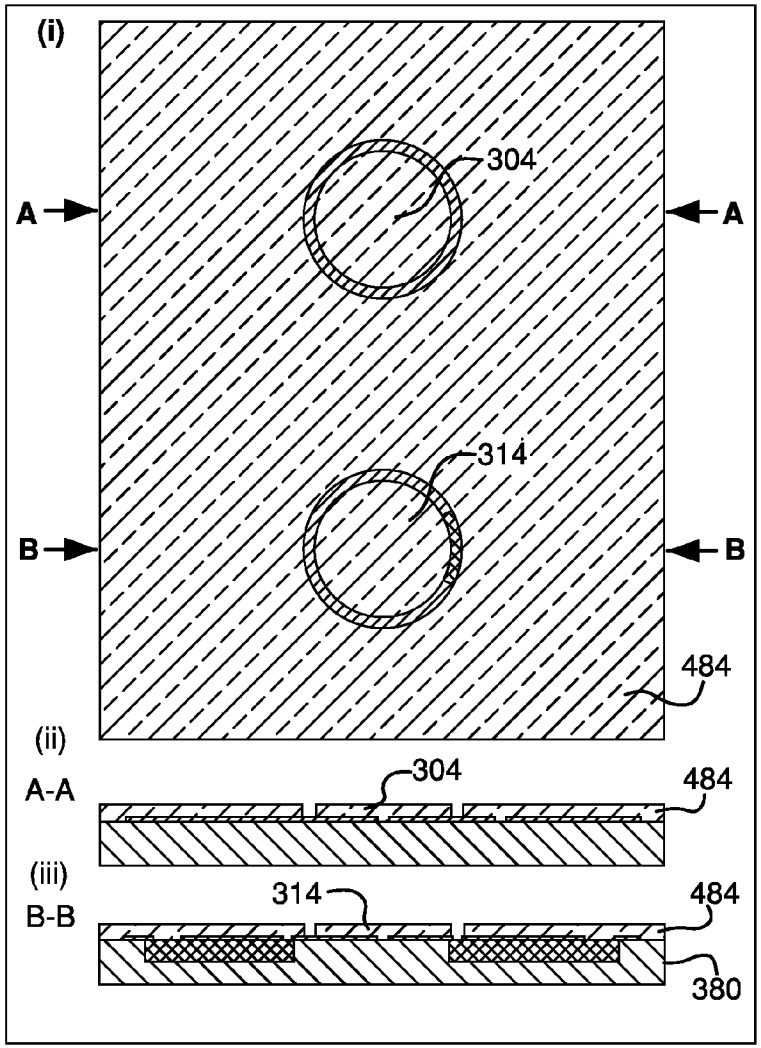

Referring to FIGS. 4C(i)-(iii), first, a poly-silicon layer 484 is deposited over the structure of FIG. 4B. Layer 484 is then patterned and etched as indicated to form electrodes 304 and 314.

Referring to FIGS. 4D(i)-(iii), first, a fast-etching silicon oxide layer 486 is deposited over the structure of FIG. 4C. Layer 486 is then patterned and etched as indicated. The thickness of layer 486 determines the spacing between each of electrodes 304 and 314 and the respective membrane (not formed yet).

Figure 4F:
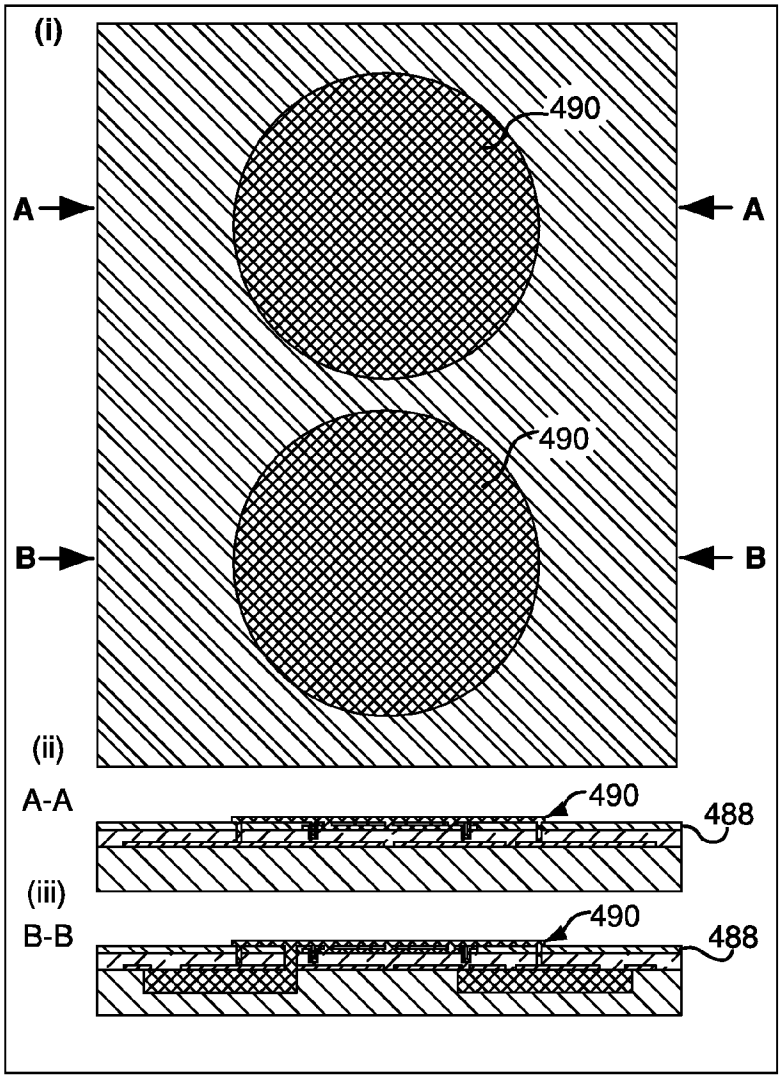
Figure 4E:
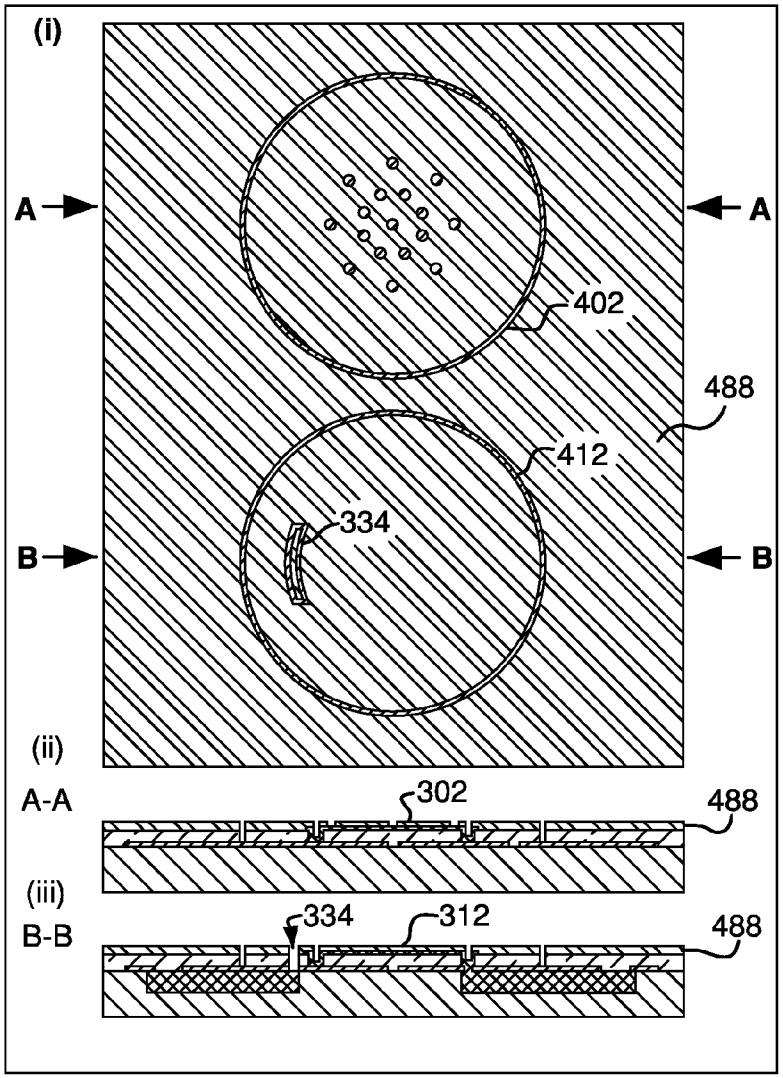

Referring to FIGS. 4E(i)-(iii), first, a poly-silicon layer 488 is deposited over the structure of FIG. 4D. Layer 484 is then patterned and etched as indicated to form membranes 302 and 312, slot 334, and circular trenches 402 and 412. Trenches 402 and 412 serve to electrically isolate membranes 302 and 312, respectively, from the main body of sensor 320.

Referring to FIGS. 4F(i)-(iii), first, a fast-etching silicon oxide layer 490 is deposited over the structure of FIG. 4E. Layer 490 is then patterned and etched as indicated to define volume 336 and the gap between membrane 302 and cover 324.

Figure 4G:
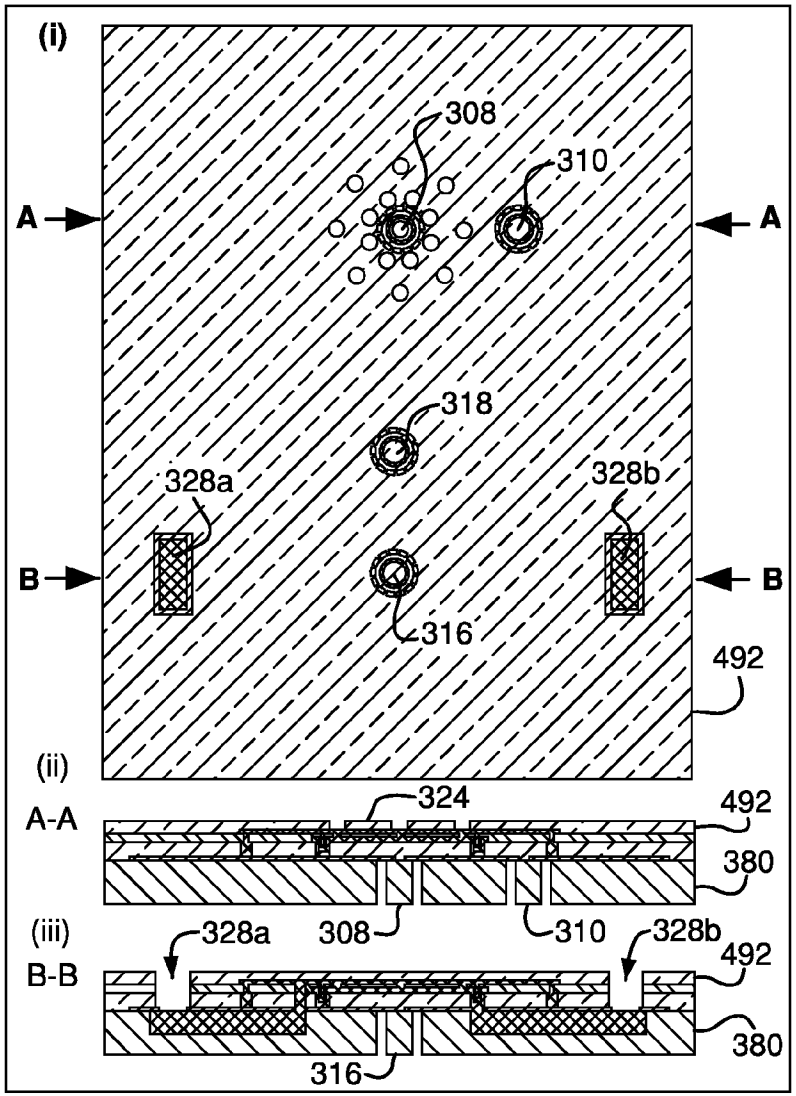

Referring to FIGS. 4G(i)-(iii), first, a poly-silicon layer 492 is deposited over the structure of FIG. 4F. Layer 492 creates cover 324 and the upper wall for volume 336. Layer 492 is patterned and etched as indicated to perforate cover 324 and to create inlet ports 328*a-b*. Substrate 380 is then deep-etched to create trench-isolated electrical leads 308, 310, 316, and 318. Finally, all exposed fast-etching silicon oxide is etched away to arrive at the structure of sensor 320 shown in FIG. 3.

In one embodiment, substrate 380 has a thickness of about 300 μm, and each of the cavities is about 10 μm deep. Layers 482, 484, 486, 488, 490, and 492 have the following respective thicknesses: 0.1, 2, 1, 1, 1, and 5 μm. As a result, sensor 320 has a total thickness of about 310 μm.

While this invention has been described with reference to illustrative embodiments, this description is not intended to be construed in a limiting sense. For example, each of sensors 220 and 320 can be implemented as a MEMS device. Various surfaces may be modified, e.g., by metal deposition for enhanced electrical conductivity, or by ion implantation for enhanced mechanical strength. Differently shaped chambers, volumes, channels, slots, inlet ports, membranes, electrodes, and/or electrical leads may be implemented without departing from the scope and principle of the invention. Various modifications of the described embodiments, as well as other embodiments of the invention, which are apparent to persons skilled in the art to which the invention pertains are deemed to lie within the principle and scope of the invention as expressed in the following claims.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Reference herein to "one embodiment" or "an embodiment" means that a particular feature, structure, or characteristic described in connection with the embodiment can be included in at least one embodiment. The appearances of the phrase "in one embodiment" in various places in the specification are not necessarily all referring to the same embodiment, nor are separate or alternative embodiments necessarily mutually exclusive of other embodiments. The same applies to the term "implementation."

Throughout the detailed description, the drawings, which are not to scale, are illustrative only and are used in order to explain, rather than limit the invention. The use of terms such as height, length, width, top, bottom, is strictly to facilitate the description of the invention and is not intended to limit the invention to a specific orientation. For example, height does not imply only a vertical rise limitation, but is used to identify one of the three dimensions of a three-dimensional structure as shown in the figures. Such "height" would be vertical where a wafer is horizontal, but would be horizontal where the wafer is vertical, and so on. Similarly, while many figures show the different structural layers as horizontal layers, such orientation is for descriptive purpose only and not to be construed as a limitation.

For the purposes of this specification, a MEMS device is a device having two or more parts adapted to move relative to one another, where the motion is based on any suitable interaction or combination of interactions, such as mechanical, thermal, electrical, magnetic, optical, and/or chemical interactions. MEMS devices are fabricated using micro- or smaller fabrication techniques (including nano-fabrication techniques) that may include, but are not necessarily limited to: (1) self-assembly techniques employing, e.g., self-assembling monolayers, chemical coatings having high affinity to a desired chemical substance, and production and saturation of dangling chemical bonds and (2) wafer/material processing techniques employing, e.g., lithography, chemical vapor deposition, patterning and selective etching of materials, and treating, shaping, plating, and texturing of surfaces. The scale/size of certain elements in a MEMS device may be such as to permit manifestation of quantum effects. Examples of MEMS devices include, without limitation, NEMS (nano-electromechanical systems) devices, MOEMS (micro-opto-electromechanical systems) devices, micromachines, Microsystems, and devices produced using microsystems technology or microsystems integration.

Although the present invention has been described in the context of implementation as MEMS devices, the present invention can in theory be implemented at any scale, including scales larger than micro-scale.

I claim:

1. A device, comprising:

a microphone adapted to generate a first electrical signal in response to a sound wave from a sound-wave source;

a differential pressure sensor (DPS) adapted to generate a second electrical signal in response to a pressure difference induced therein by said sound wave, said second electrical signal being different from the first electrical signal; and circuitry adapted to process the first electrical signal and the second electrical signal to determine a direction angle corresponding to the sound-wave source.

2. The invention of claim 1, wherein the circuitry comprises:

a first detector adapted to measure an amplitude of the sound wave based on the first electrical signal;

a second detector adapted to detect a component of the second electrical signal that has a substantially 90-degree phase shift with respect to the first electrical signal to measure an amplitude of the pressure difference induced in the DPS by the sound wave; and a signal processor adapted to determine the direction angle based on the amplitude of the sound wave and the amplitude of said pressure difference.

3. The invention of claim 2, wherein, to detect said component, the second detector is adapted to apply phase-sensitive detection to the second electrical signal using the first electrical signal as a reference signal for said phase-sensitive detection.

4. The invention of claim 2, wherein the signal processor is adapted to:

determine a ratio between the amplitude of said pressure difference and the amplitude of the sound wave; and determine the direction angle based on said ratio.

5. The invention of claim 1, wherein the DPS comprises:

a chamber having first and second inlet ports; and a first movable membrane that divides the chamber into first and second portions, wherein:

the first inlet port is adapted to admit the sound wave into the first portion;

the second inlet port is adapted to admit the sound wave into the second portion;

the pressure difference is a pressure difference between the first and second portions induced by the sound wave at the first movable membrane; and the first movable membrane is adapted to move in response to said pressure difference.

6. The invention of claim 5, wherein the DPS further comprises:

a first electrode, wherein the first movable membrane and the first electrode form a first capacitor whose capacitance is responsive to displacement of the first movable membrane induced by the pressure difference, wherein the DPS is adapted to generate the second electrical signal based on changes in said capacitance.

7. The invention of claim 5, wherein:

the microphone comprises a second movable membrane; and the first movable membrane is substantially orthogonal to the second movable membrane.

8. The invention of claim 5, wherein:

the microphone comprises a second movable membrane; and the first movable membrane is substantially parallel to the second movable membrane.

9. The invention of claim 8, wherein the first movable membrane of and the second movable membrane have been fabricated using different respective portions of a single layer of a multilayered wafer.

10. The invention of claim 5, wherein a distance between the first and second inlet ports is smaller than about 7 mm.

11. The invention of claim 1, further comprising a display screen configured to display the direction angle.

12. The invention of claim 6, wherein the DPS further comprises a second electrode, wherein the first movable membrane and the second electrode form a second capacitor whose capacitance is responsive to the displacement of the first movable membrane induced by the pressure difference, wherein the DPS is adapted to generate a third electrical signal based on changes in the capacitance of the second capacitor.

13. A method of sound detection, comprising:

generating a first electrical signal using a microphone configured to receive a sound wave from a sound-wave source;

generating a second electrical signal using a differential pressure sensor (DPS) configured to respond to a pressure difference induced in the DPS by said sound wave, said second electrical signal being different from the first electrical signal; and processing the first electrical signal and the second electrical signal to determine a direction angle corresponding to the sound-wave source.

14. The invention of claim 13, wherein the step of processing comprises:

measuring an amplitude of the sound wave based on the first electrical signal;

detecting a component of the second electrical signal that has a substantially 90-degree phase shift with respect to the first electrical signal to measure an amplitude of the pressure-difference induced by the sound wave, said pressure difference corresponding to a pressure difference between a first inlet port of the DPS and a second inlet port of the DPS; and determining the direction angle based on the amplitude of the sound wave and the amplitude of said pressure difference.

15. The invention of claim 14, wherein the step of detecting comprises applying phase-sensitive detection to the second electrical signal using the first electrical signal as a reference signal for said phase-sensitive detection.

16. The invention of claim 14, wherein the step of determining further comprises:

determining a ratio between the amplitude of said pressure difference and the amplitude of the sound wave; and determining the direction angle based on said ratio.

17. The invention of claim 14, the step of measuring the amplitude comprises applying phase-sensitive detection to the first electrical signal.

18. The invention of claim 13, further comprising displaying the direction angle on a display screen.

19. An integrated device, comprising:

a microphone formed in a multilayered wafer and adapted to generate a first electrical signal in response to a sound wave; and a differential pressure sensor (DPS) formed in the multilayered wafer and adapted to generate a second electrical signal in response to a pressure difference induced therein by said sound wave, said second electrical signal being different from the first electrical signal, wherein:

the DPS comprises:

a chamber having first and second inlet ports; and a first movable membrane that divides the chamber into first and second portions, wherein:

the first inlet port is adapted to admit the sound wave into the first portion;

the second inlet port is adapted to admit the sound wave into the second portion;

the pressure difference is a pressure difference between the first and second portions induced by the sound wave at the first movable membrane; and the first movable membrane is adapted to move in response to said pressure difference;

the microphone comprises a second movable membrane; and the first movable membrane and the second movable membrane have been fabricated using different respective portions of a single layer of a multilayered wafer.

20. A device, comprising:

a microphone adapted to generate a microphone signal in response to a sound wave from a sound-wave source;

a differential pressure sensor (DPS) adapted to generate a DPS signal in response to a pressure difference induced therein by said sound wave; and circuitry adapted to determine direction to the sound-wave source based on the microphone signal and the DPS signal, wherein the DPS comprises:

a chamber having first and second inlet ports; and a membrane that divides the chamber into first and second portions, wherein:

the first inlet port is adapted to admit the sound wave into the first portion;

the second inlet port is adapted to admit the sound wave into the second portion;

the pressure difference is a pressure difference between the first and second portions induced by the sound wave;

the membrane is adapted to move in response to said pressure difference; and a distance between the first and second inlet ports is smaller than about 7 mm.

* * * * *

UNITED STATES PATENT AND TRADEMARK OFFICE

CERTIFICATE OF CORRECTION

PATENT NO. : 8,553,903 B2
APPLICATION NO. : 11/769142
DATED : October 8, 2013
INVENTOR(S) : Dennis S. Greywall It is certified that error appears in the above-identified patent and that said Letters Patent is hereby corrected as shown below:

In the Claims

In column 8, claim 9, line 7, delete the word "of".

Signed and Sealed this
Twenty-second Day of April, 2014

Michelle K. Lee

Michelle K. Lee
*Deputy Director of the United States Patent and Trademark Office*